United States Patent [19]

Kvalheim et al.

[11] Patent Number: 4,765,684

[45] Date of Patent: Aug. 23, 1988

[54] MULTI-PURPOSE CHAIR WITH RETRACTABLE KNEE REST

[75] Inventors: Andrew M. Kvalheim; Flemming M. Pedersen, both of Petaluma, Calif.

[73] Assignee: KVAL Marketing Inc., Petaluma, Calif.

[21] Appl. No.: 28,579

[22] Filed: Mar. 20, 1987

[51] Int. Cl.[4] ..... A47C 7/50

[52] U.S. Cl. ..... 297/429; 297/313

[58] Field of Search ..... 297/429, 430, 431, 423, 297/426, 427, 437, 438, 313, 354, 357

[56] References Cited

U.S. PATENT DOCUMENTS

| | | | |
|---|---|---|---|
| 1,301,835 | 4/1919 | Glenister | 297/430 X |
| 1,357,826 | 11/1920 | Shaw | 297/354 |
| 2,484,803 | 10/1949 | Bell et al. | 297/432 |
| 2,542,480 | 2/1951 | Cramer et al. | 297/354 X |
| 3,429,612 | 2/1969 | Cobb | 297/429 X |
| 3,669,493 | 6/1972 | Vowles | 297/429 |
| 3,794,381 | 2/1974 | Caldemeyer | 297/430 |
| 4,470,634 | 9/1984 | Delius et al. | 297/429 |
| 4,534,590 | 8/1985 | Yamamura et al. | 297/423 X |
| 4,589,699 | 5/1986 | Dungan | 297/423 |
| 4,650,249 | 3/1987 | Serber | 297/423 X |

FOREIGN PATENT DOCUMENTS

| | | | |
|---|---|---|---|
| 75596 | 5/1976 | Australia | 297/430 |
| 356249 | 9/1961 | Switzerland | 297/431 |

*Primary Examiner*—Kenneth J. Dorner
*Assistant Examiner*—José V. Chen
*Attorney, Agent, or Firm*—Alfons Puishes

[57] ABSTRACT

Attachments and adjustments are applied to conventional chairs which provide a knee rest normally positioned in a retracted position beneath the seat cushion. Special mechanisms permit withdrawal of the cushion to a position facing the seat cushion and tilting the seat cushion to permit use of the chair in a knee rest position and provide for return of the cushion to its original position. Related mechanisms provide for corresponding adjustments to the seat rest and the back rest to effect conversion of the chair from conventional to other uses. The latter include adjustment of the seat rest and back rest to convert the chair for use in a lounge position.

3 Claims, 7 Drawing Sheets

MULTI-PURPOSE CHAIR WITH RETRACTABLE KNEE REST

FIELD OF THE INVENTION

This invention relates to chairs both for home and office use and particularly to chairs for providing comfort and relief to the bodies of persons from long sitting or persons afflicted with body ailments aggravated by sitting in a conventional seated postion. More specifically it is concerned with chairs of the "sit-kneel" type in which the user's weight is partially supported by his knees and with chairs that may be readily converted from conventional seating type to chairs of the knee rest type.

BACKGROUND OF THE INVENTION AND PRIOR ART

It has long been recognized by physicians and therapists that sitting in a conventional chair for long periods of time produces back and muscle complaints as well as discomfort to the stomach and neck. This is brought about by the weight distribution which follows from the 90 degree angle which the body basically must assume when in a conventional sitting position. Persons working at a typewriter or computer console are known to especially suffer in this manner and the condition is obviously aggravated in the case of persons already having back complaints. To solve this problem there have been in use now for some years various embodiments of a therapeutic chair which eliminates the conventional backrest and instead provides a knee rest for the user upon which he may effectively lean forward and have his knnes absorb some of his weight, thus relieving the back and spine. Such chairs have found wide use, not only in offices, but in homes as for example, for prolonged watching of television in addition to use by people having back troubles as mentioned above and in particular by pregnant women.

There is substantial prior patent art in this field, of which the following are examples.

U.S. Pat. No. 3,669,493 to Vowles. In addition to the provisions for a chair in the knee rest position, this patent also claims an arcuate support for the feet as an additional feature.

U.S. Pat. No. 4,328,991 to Mengshoel teaches a chair of this type mounted on runners after the manner of a rocking chair, which is an additional claimed feature.

U.S. Pat. No. 4,377,309 to Mengshoel teaches an ankle and knee support element and a storage space for the latter beneath the seat. It also claims variations of ankle supports and is thus distinguished from Vowles above.

U.S. Pat. No. 4,564,237 to Steifensand. This patent teaches a tubular wide frame support of a chair of this type to provide better stability, improved construction and assembly as distinguished from the foregoing.

U.S. Pat. No. 4,589,699 to Dungan. In addition to a separate angular tilting arrangement for the seat and knee rest, this patent covers the feature of a variation in lateral space between the seat and knee rest members as an improvement over the prior art.

A number of design patents have issued covering ornamental features of various emobidments of these chairs indicating their wide adoption.

In actual practice it is often customary to use a conventional chair for a period of time and then switch to a knee rest type of chair to obtain the relief afforded for a while and then switch back to a conventional chair. This, of course, requires having two separate chairs which is cumbersome especially in a business office.

Nowhere does the prior art suggest the construction of a chair which may be readily converted from conventional to therapeutic use as described above or for lounging use.

SUMMARY OF THE INVENTION

We have invented a means of converting a conventional chair, either for office or home use, to function also as a therapeutic chair as described in the background information above. This we accomplish by providing a knee rest attachment positioned under the seat of the chair when the latter is in conventional use and withdrawn by means of specially constructed mechanism to provide a knee rest and at the same time providing for changing the inclination of the seat of the chair so that it may be used for therapeutic purposes. For this we utilize two different embodiments of our basic chair as described above.

In the first embodiment which we designate as our chair No. 1, we use a link and lever mechanism which permits a separate cushion to be positioned under the seat of the chair and to be withdrawn and positioned in front of the chair facing the seat and fixed in place to act as a knee rest and at the same time provide for adjustment of the angle of the seat. When it is desired to return the chair to conventional use, the mechanism operates to re-position or stow the cushion under the seat again.

In our second embodiment of our basic chair which we designate as our chair No. 2, we mount the separate cushion on a rail sliding on rollers which permits it to be slid out from under the seat to a knee rest position in front of the chair and back again under the seat, also providing for adjustment of the seat of the chair. In this embodiment we provide a further variation which permits the back rest to be inclined backward to provide a reclining or lounge type of chair. All of the above are illustrated in the figures and description which follow.

DESCRIPTION OF A PREFERRED EMBODIMENT

Figure 1:
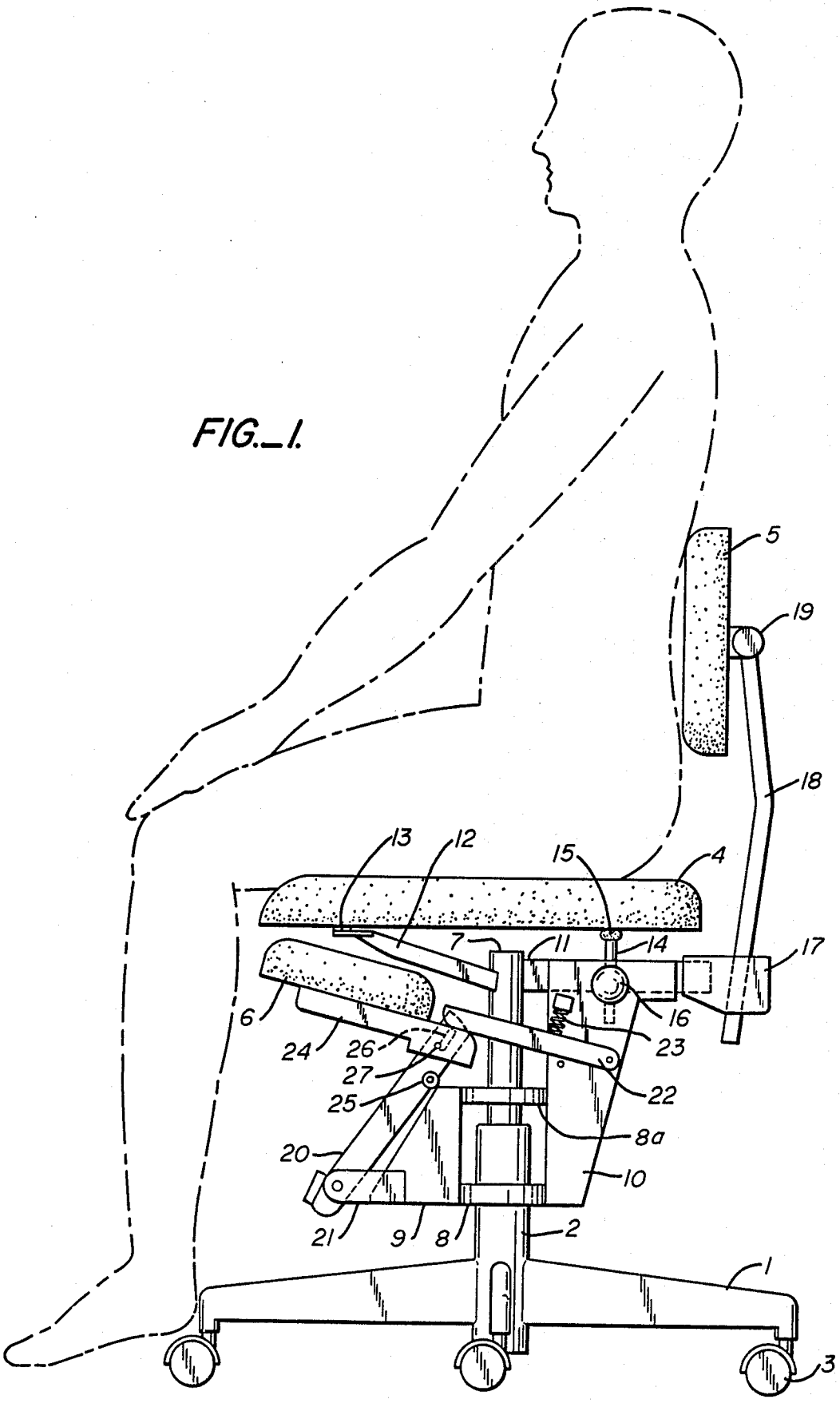
FIG. 1 is a side elevation of chair No. 1 in conventional position No. 1.

Referring now particularly to FIGS. 1 through 4, there is seen first a support structure 1 with central supporting cylinder 2 and casters 3. These are similar to those found on a conventional chair of this type. A seat cushion shown at 4 and a back rest cushion at 5. A retractable knee rest cushion is shown at 6. Support piston 7 rides in support cylinder 2. The entire mechanism assembly is supported on collars 8 and 8*a*, 8 riding freely on support cylinder 2 and 8*a* being fixedly positioned on piston 7.

Attached to these rings is front gusset 9 and rear gusset 10, the latter being provided additional support at its top by strut No. 11. Forward seat support 12 is also positioned on piston 7 and slidably supports cushion 4 by means of flexible pad 13. Cushion 4 is also supported at its rear edge by adjustable strut 14 which makes contact with the lower surface of cushion 4 through ball-shaped aligner 15. The tilt of cushion 4 may be adjusted by means of knob 16 and vertical strut 14. The back rest cushion structure is supported from strut 11 by means of holder 17, back rest support post 18 and back rest angle adjusting knob 19.

Figure 3:
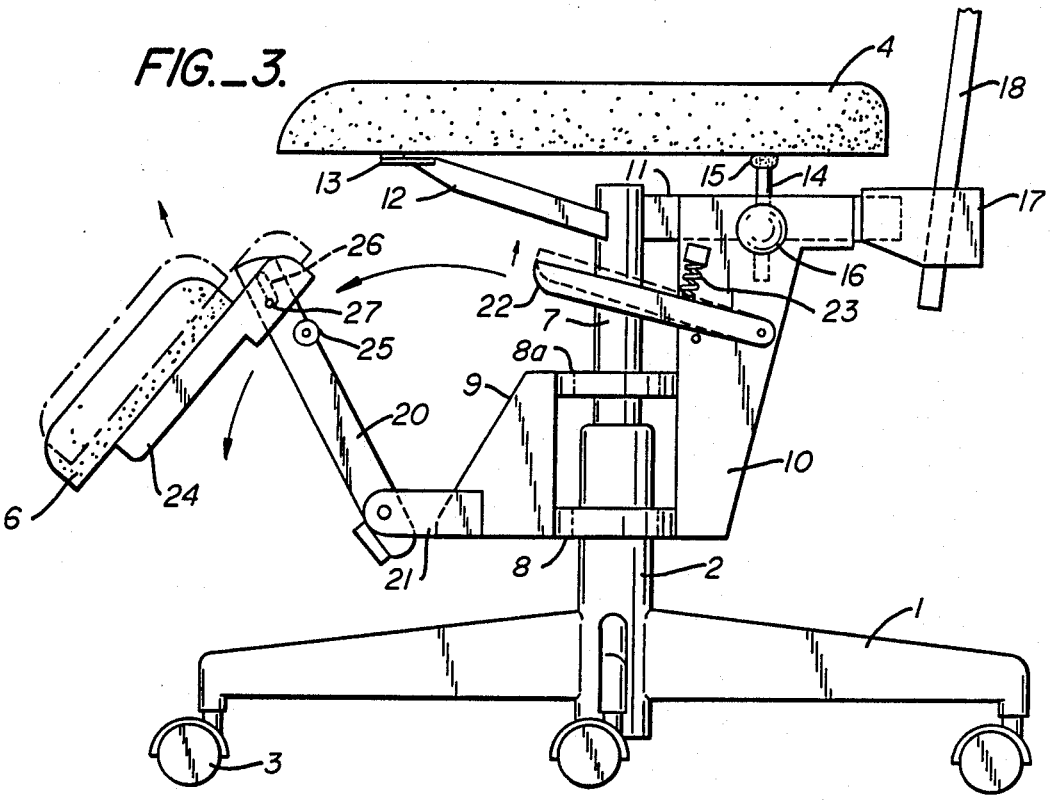
FIG. 3 is a side elevation of chair No. 1 showing the first step in positioning of the knee rest.
Figure 4:
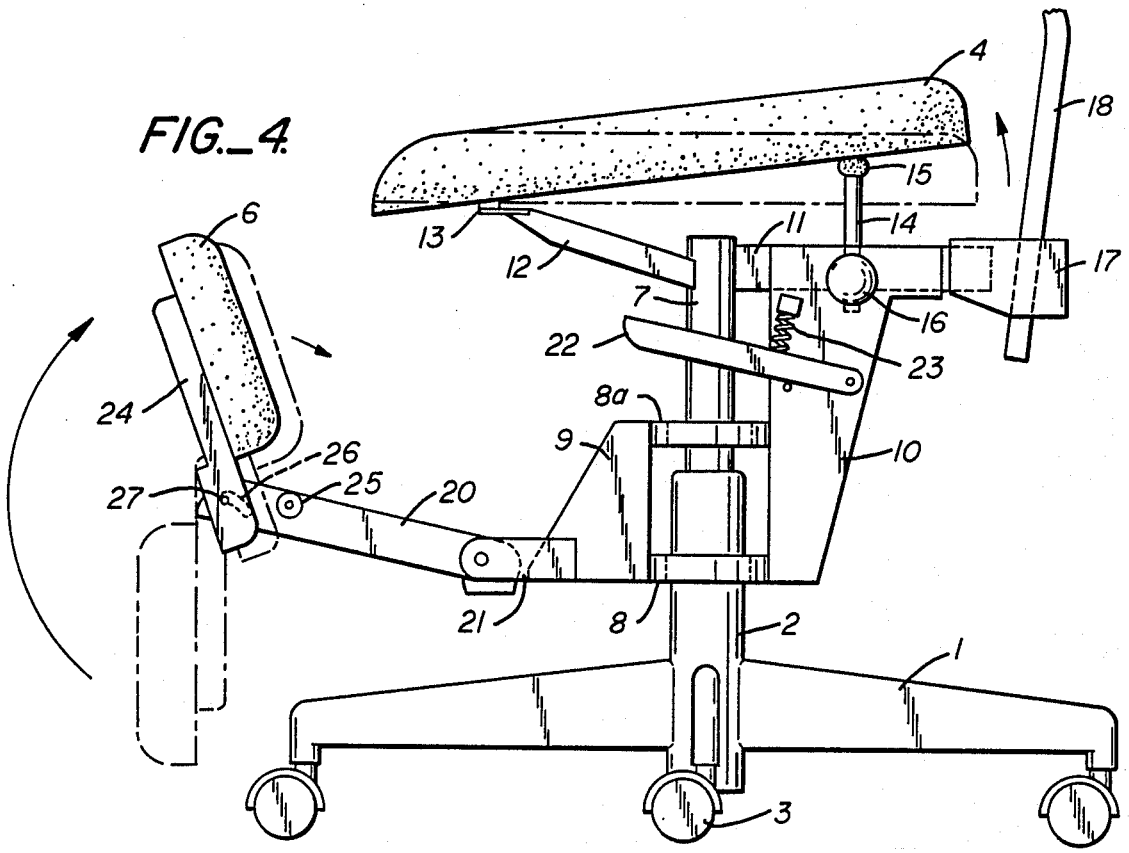
FIG. 4 is a side elevation of chair No. 1 showing further steps in positioning knee rest.

Referfence should now also be had especially to FIG. 3 and FIG. 4 for a better explanation of the retraction mechanism and its method of operation. Knee rest retraction lever 20 is pivotally mounted on member 21, which in turn is fixedly positioned on forward gusset 9. Latch 22 is atuated by spring 23, both of which are mounted on rear gusset plate 10. Knee rest cushion 6 is fixedly supported on a swivelling support member 24 upon one end of which is positioned pin 27. Pin 27, in turn is disposed to ride in an "L" shaped slot 26 in lever 20 to provide for positioning of the knee rest as shown in FIGS. 3 and 4 and explained more fully below. A roller 25 positioned on lever 20 also assists in positioning of the knee rest support plate 24 and holding it in knee rest position. Aforementioned latch 22 engages the top surface of plate 24 when it is in retracted position.

Figure 2:
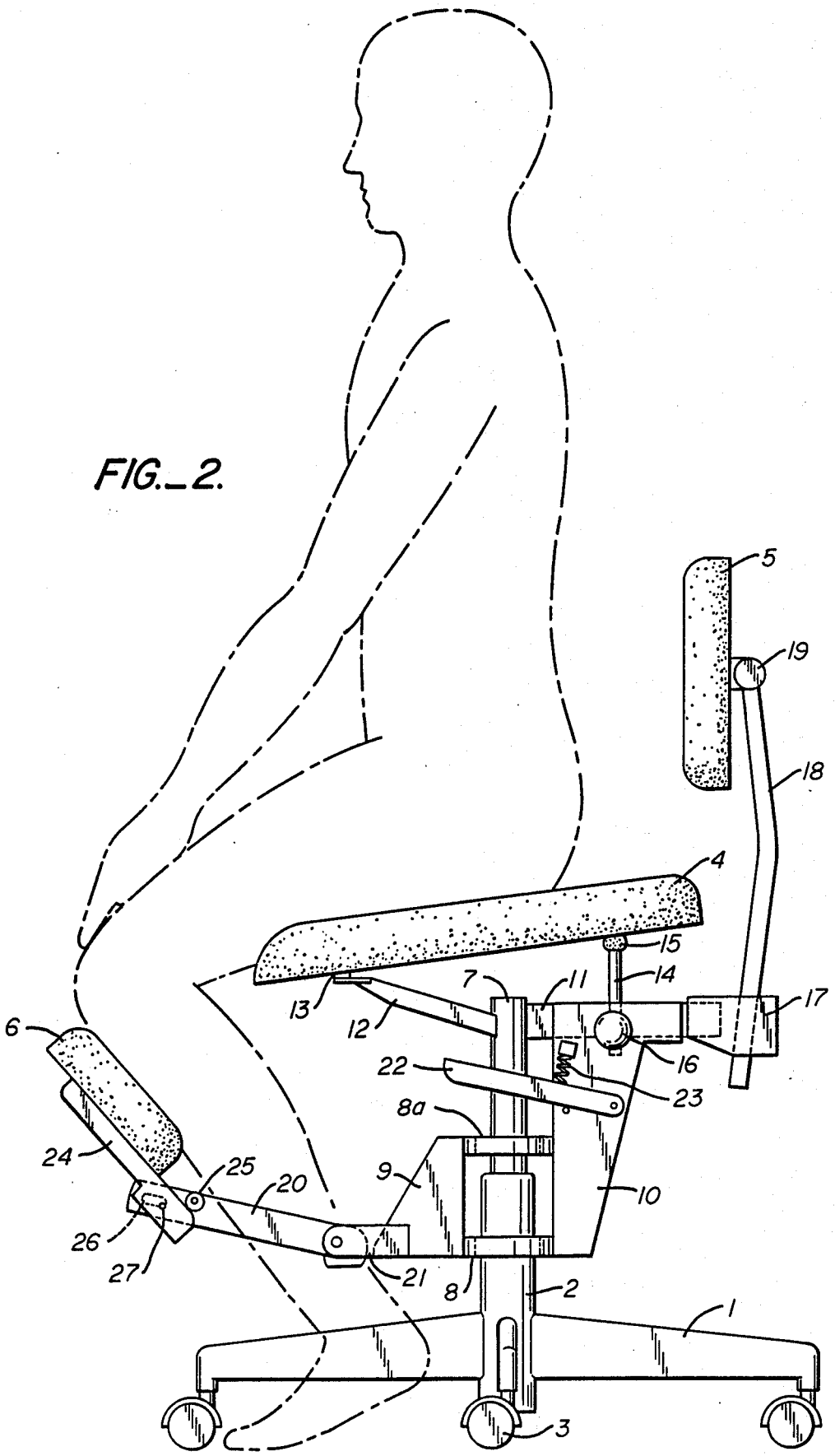
FIG. 2 is a side elevation of chair No. 1 in knee rest position No. 2.

To convert the chair from conventional use shown in FIG. 1 to knee rest use shown in FIG. 2, latch 22 is first raised to disengage it from support plate 24 and cushion 6 withdrawn as shown on FIG. 3. Lever 20 being rotated in counter-clockwise direction as indicated by the arrows. Plate 24 is then loose in slot 26 and cushion 6 may be withdrawn further in an upwards direction, plate 24 moving correspondingly in slot 26. Plate 24 may next be rotated in a clockwise direction upwards again wtih the motion provided by "L" slot 26 and pin 27. Further movement in the slot brings plate 24 into a position wherein its upper surface may be engaged by roller 25 which holds cushion 6 in the knee rest position shown in FIG. 2.

Reversing the foregoing steps will bring cushion 6 back to its position shown on FIG. 1 underneath cushion 4 and the chair returned for normal seating use.

Alternate Embodiments

Reference should now be had to FIGS. 5 through 9 in which are seen alternate embodiments of our basic chair. Here in supporting structure shown at 31, a seat cushion at 32 and a back rest cushion at 33, the retractable knee rest cushion is shown at 34. An adjusting linkage 35 serves to tilt back rest cushion 32 forward by means of handle 36, the cushion being pivoted on pin 37 supported on support structure 31. The back rest 33 in turn is pivoted at its upper end on structure 31 and equipped with link mechanism 38 for adjusting its angular position.

Transport rails 39 are positioned below seat cushion 32 and supported by transport rollers or sheaves 40 which are positioned on the structure as seen on FIG. 7. Knee rest rail adjusting latch is shown at 42 which engages notches 43 in rail 39 by means of handle 44. Travel of rails 39 is controlled by stop 45.

Figure 6:
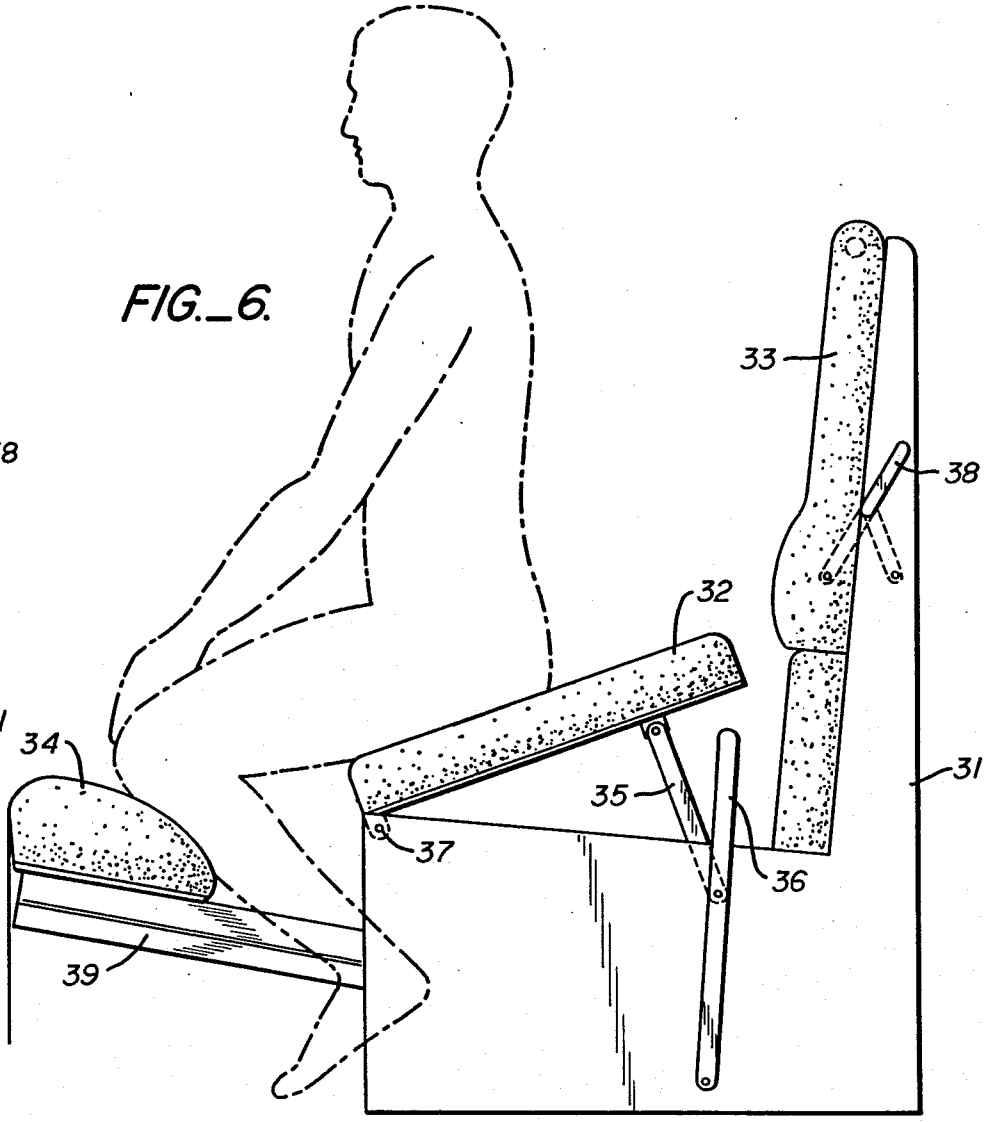
FIG. 6 is a side elevation of chair No. 2 in knee rest position No. 2.
Figure 5:
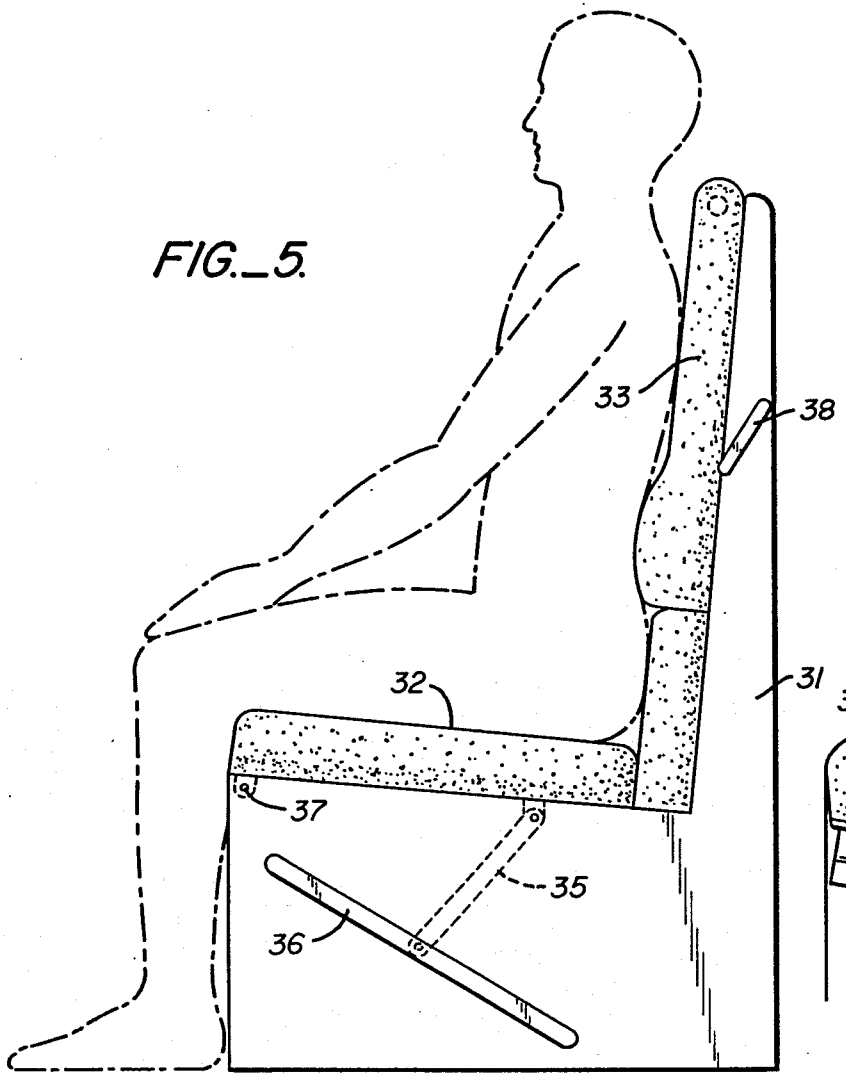
FIG. 5 is a side elevation of chair No. 2 in conventional sitting position No. 1.
Figure 7:
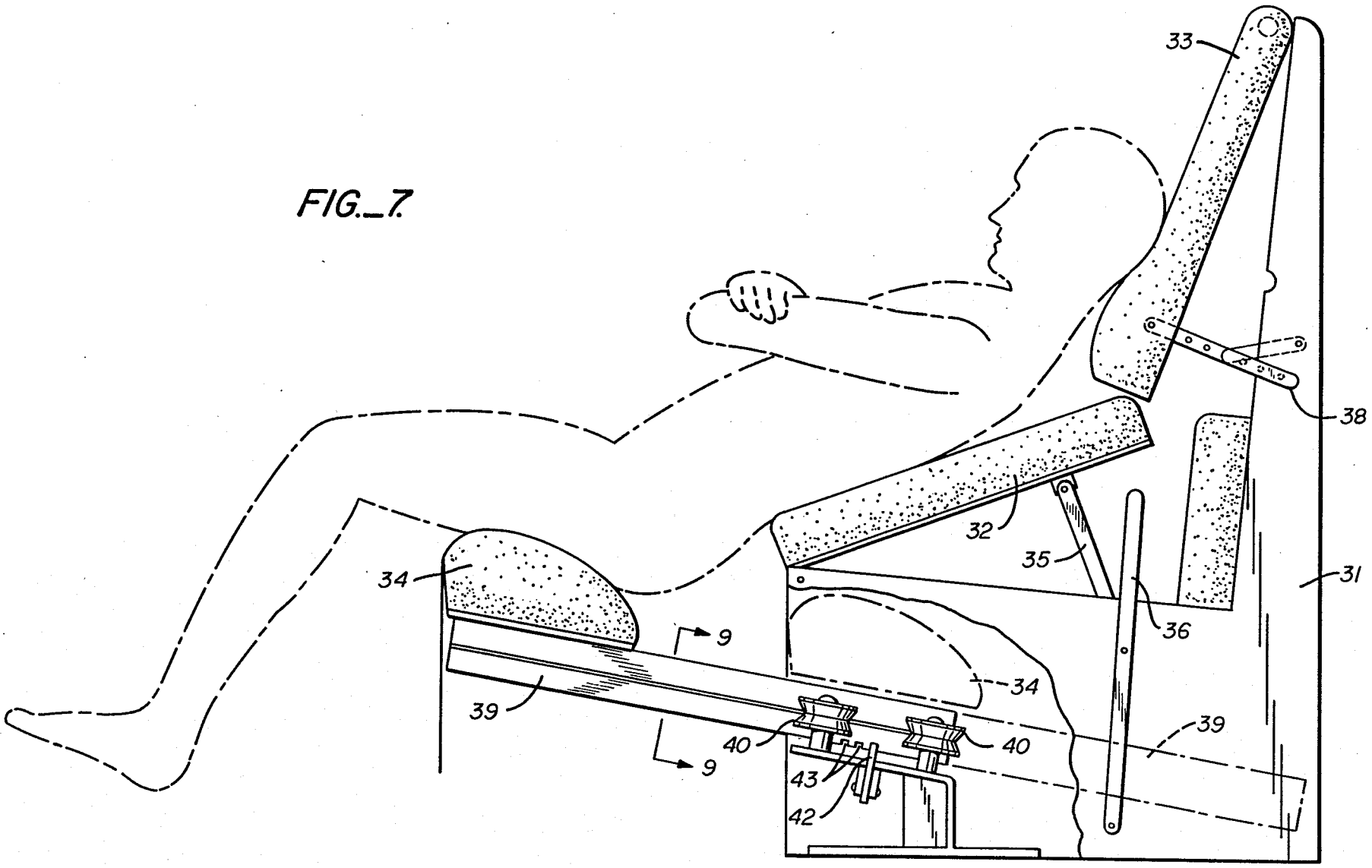
FIG. 7 is a side elevation of chair No. 2 in lounge position No. 3 partially cut away.
Figure 8:
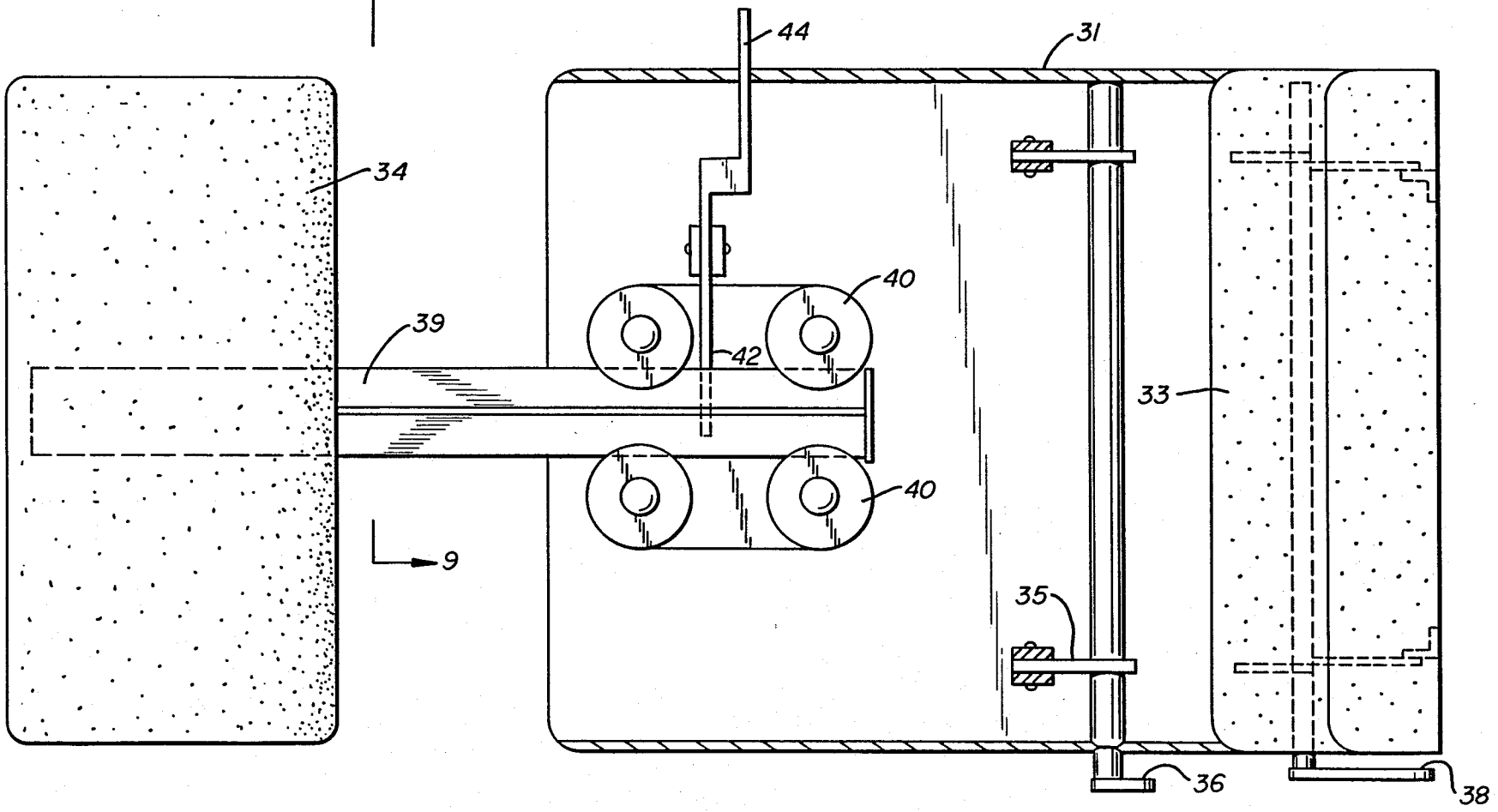
FIG. 8 is a partial plan view of the chair of FIG. 5 showing operating mechanism.

To use the chair in lounge position as shown in FIG. 7, knee rest cushion 34 is withdrawn to knee rest position as shown in FIG. 6 and back rest cushion 33 is tilted forward by means of linkage 38 so that the knee rest becomes a seat rest, the former seat rest becomes a back rest, and the former back rest becomes a head rest, all as shown in FIG. 7.

Figures 9, 10:
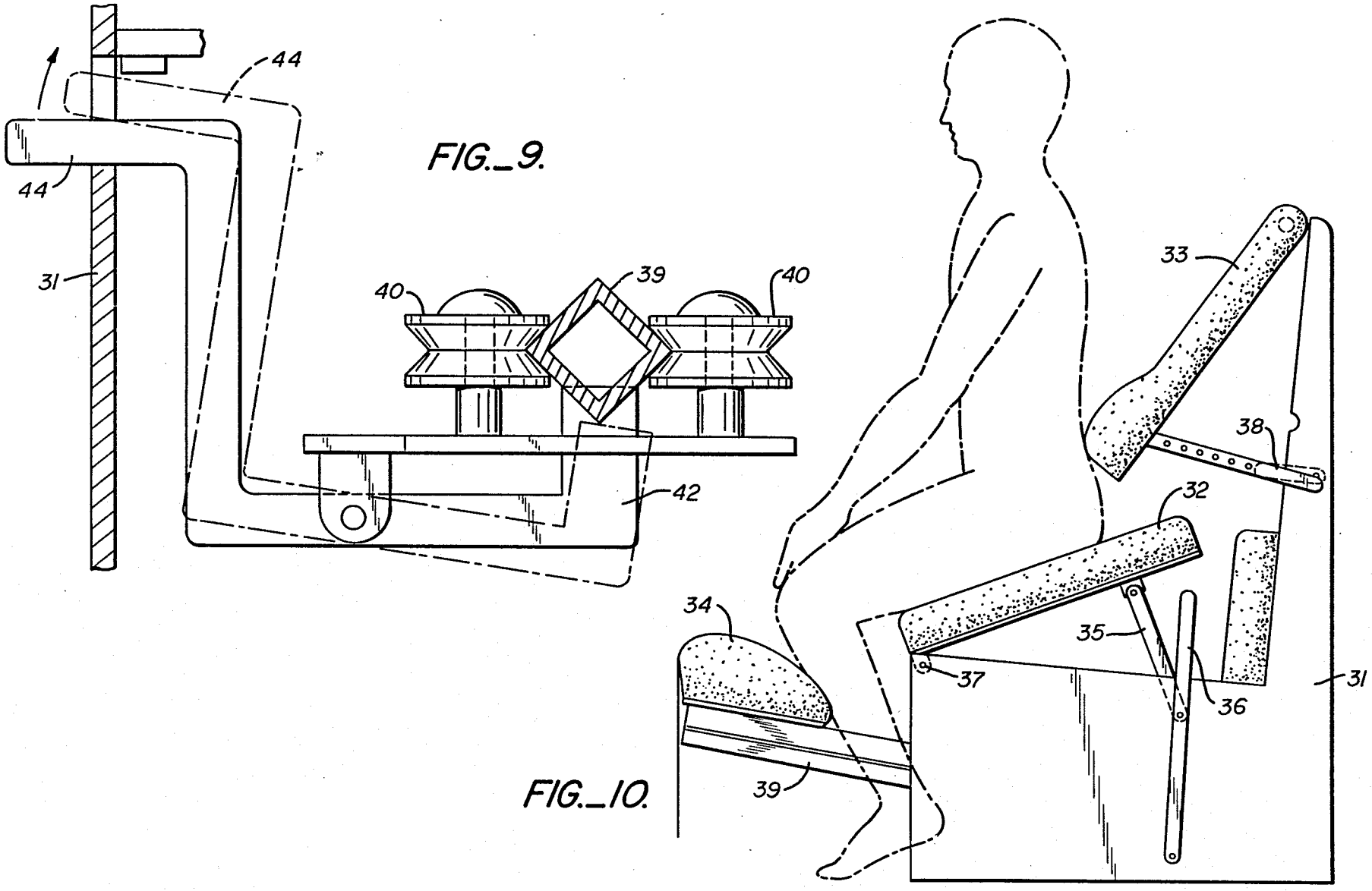
FIG. 9 is section 9—9 of FIG. 8 showing detail of the latch mechanism.
FIG. 10 is side elevation of chair No. 2 in knee rest position No. 2 with back rest.

Back rest cushion 33 may be adjusted by an extension of link mechanism 38 to continue to function as a back rest when the chair is in a knee rest position as shown on FIG. 10.

We claim:

1. In a conventional chair having a substantially horizontal seat cushion, a substantially vertical back rest cushion and a central support column the improvement of a knee rest disposed to support the knees of an occupant in a knee rest position while seated in said chair comprising:

a forward gusset plate positioned on said support column;

a rear gusset plate positioned on said support column;

a retractable knee rest cushion;

said knee rest cushion being initially positioned underneath said seat cushion and fixedly mounted on a supporting lever;

one end of said supporting lever having a pin fixedly positioned thereon;

said pin being slidably and rotatably engaged in an "L" slot positioned at the first end of a retraction lever;

a pivot positioned on said forward gussest plate;

said retraction lever being rotatably mounted on said pivot;

said retraction lever being further disposed to transport said supporting lever and said knee rest cushion outward from said initial position to a knee rest position facing said seat cushion;

a roller positioned on said retraction lever adjacent said "L" shaped slot and disposed to engage said support lever and hold said knee rest cushion in said knee rest position;

a latch positioned on said rear gusset;

said latch being disposed to engage said supporting lever when said knee rest cushion is in said initial position;

means for tilting said seat cushion forward towards said knee rest position.

2. The chair of claim 1 including means for adjusting the height of said back rest cushion with respect to said seat cushion.

3. The chair of claim 1 including means for adjusting the angle of said back rest cushion with respect to said seat cushion.

* * * * *